US006637157B1

(12) United States Patent
Dombrowski et al.

(10) Patent No.: US 6,637,157 B1
(45) Date of Patent: Oct. 28, 2003

(54) VEHICLE LIFTGATE POWER OPERATING SYSTEM

(75) Inventors: Douglas Dombrowski, Troy, MI (US); Joseph Michael Johnson, Huntington Woods, MI (US); Howard Warren Kuhlman, Rochester Hills, MI (US); Michael G. Wygle, Auburn Hills, MI (US)

(73) Assignee: Delphi Technologies, Inc., Troy, MI (US)

( * ) Notice: Subject to any disclaimer, the term of this patent is extended or adjusted under 35 U.S.C. 154(b) by 23 days.

(21) Appl. No.: 09/685,548

(22) Filed: Oct. 10, 2000

Related U.S. Application Data

(60) Provisional application No. 60/170,211, filed on Dec. 10, 1999.

(51) Int. Cl.[7] ..... E05F 11/24

(52) U.S. Cl. ..... 49/341; 49/340; 49/345

(58) Field of Search ..... 49/339, 340, 341, 49/342, 345, 346; 296/56

(56) References Cited

U.S. PATENT DOCUMENTS

| | | | | | |
|---|---|---|---|---|---|
| 910,248 | A | * | 1/1909 | Weber | 49/341 |
| 1,769,723 | A | * | 7/1930 | Terhune | 49/341 |
| 3,343,303 | A | * | 9/1967 | Wanlass | 49/280 |
| 3,713,472 | A | * | 1/1973 | Dozois | 160/189 |
| 3,716,945 | A | * | 2/1973 | Cooper et al. | 49/139 |
| 4,572,572 | A | * | 2/1986 | Nakamura et al. | 296/223 |
| 4,725,093 | A | * | 2/1988 | Betteridge | 296/223 |
| 6,055,775 | A | * | 5/2000 | Dering et al. | 49/340 |
| 6,055,776 | A | * | 5/2000 | Dettling et al. | 49/341 |
| 6,092,336 | A | * | 7/2000 | Wright et al. | 49/339 |
| 6,092,337 | A | * | 7/2000 | Johnson et al. | 49/340 |
| 6,137,249 | A | * | 10/2000 | Butler et al. | 318/266 |
| 6,142,551 | A | * | 11/2000 | Ciavaglia et al. | 296/56 |
| 6,234,563 | B1 | * | 5/2001 | Bascou | 296/146.8 |
| 6,283,535 | B1 | * | 9/2001 | Yuge | 296/146.8 |

* cited by examiner

*Primary Examiner*—Gregory J. Strimbu
(74) *Attorney, Agent, or Firm*—Scott A. McBain

(57) ABSTRACT

A power operating system for opening and closing a vehicle liftgate has a pair of drive units supported on the vehicle roof and connected to the liftgate for opening and closing the liftgate. Each drive unit includes a bracket that is secured to the vehicle body for supporting several parts including a reversible electric motor, a gear unit and a housing having a forward linear track and a contiguous rearward curved track. The electric motor drives a segmented drive linkage disposed in the housing via the gear unit. The segmented drive linkage includes an elongated arcuate link that is guided by the rearward curved track, a linear rack link that is guided by the forward linear track, and an intermediate link that has an outer end that is pivotally attached to an inner end of the arcuate link and an inner end that is pivotally attached to a midpoint of the linear rack link. The outboard end of the arcuate link is pivotally connected to the liftgate to open and close the liftgate as the arcuate link is extended and retracted by the linear rack link being driven by the electric motor.

8 Claims, 3 Drawing Sheets

VEHICLE LIFTGATE POWER OPERATING SYSTEM

RELATED PATENT APPLICATIONS

This application claims benefit of provisional patent application No. 60/170,211 filed Dec. 10, 1999.

TECHNICAL FIELD

This invention relates to a power operating system for a vehicle liftgate that is pivotally attached to a vehicle compartment for pivotal movement about a generally horizontal hinge axis and more particularly to a power operating system that will move a liftgate from a closed position to a fully open position and from an open position to a fully closed position.

BACKGROUND OF THE INVENTION

Utility vehicles and vans with liftgates that are hinged at the top about a generally horizontal axis are used by large numbers of people today. Some of these liftgates are large and heavy. Their size and weight make some liftgates difficult to open and close. Some of the liftgates are also a great distance above the ground when they are fully opened. Their height above the ground makes them very difficult for some people to close. For these and other reasons many people would like to have a power operating system for opening and closing the liftgate.

A number of different liftgate openers have been tried in recent years. Some of these liftgate openers have a single cable that opens and closes a liftgate in connection with a counterbalance system, such as a gas spring counterbalance system. Liftgates with a single cable opener and closer are generally trunk lids that are lightweight and have a relatively small range of movement.

Gas spring output varies with temperature. This complicates power liftgate systems that rely on gas springs to open the liftgate. The gas spring or springs must be strong enough to open the liftgate on the coldest day (−40° C.). This results in gas springs that increase closing resistance substantially on the hottest day (80° C.). Therefore a very large electric motor must be used to close the liftgate.

Liftgates that have two or more gas springs for a counter balance system are common. These gas springs generally occupy a position in which their axis is substantially parallel to the liftgate so that the gas springs are hidden when the liftgate is closed. In this closed position the moment arm of the gas springs is quite small. With such systems the lift gate may move about one-third of their total travel range before the gas cylinders exert sufficient force to open a liftgate further without the application of an independent lifting force. There are even some systems in which the gas springs pass over center and bias a liftgate toward a closed position when the liftgate is closed. With these self-closing systems a liftgate may need to be more than one-third open before the gas springs will open the liftgate further.

The force required to hold a liftgate in a given position along its path of movement from a closed position to a fully open position varies substantially in some liftgate opening systems. A power liftgate closer must exert sufficient force to hold a liftgate in any given position along the path of movement, plus the force to overcome friction, and plus the force required to accelerate the liftgate during liftgate closing. If the total force exerted by the liftgate power closure varies substantially from one position between fully opened and closed to another position between fully opened and closed, it may be difficult for the control system to detect an obstruction and stop the liftgate without incurring damage to the vehicle or to the object that obstructs the liftgate.

SUMMARY OF THE INVENTION

The object of the invention is to provide an improved vehicle liftgate power operating system.

A feature of the invention is that the vehicle liftgate power operating system can move the liftgate from a closed position to a fully opened position as well as from an open position to a fully closed position.

Another feature of the invention is that the liftgate power operating system allows the liftgate to be moved manually when an efficient gear train is selected.

Another feature of the invention is that power operating system can be stopped at any point to hold the liftgate in any intermediate position without any need for a brake, detent or the like.

Still another feature of the invention is that the drive unit of the liftgate power operating system has a segmented drive linkage attached to the liftgate that is guided by a track member that is preferably shaped to hug the interior roof structure and thus minimize intrusion into the cargo area of the vehicle and maximize the unobstructed load height at the liftgate opening.

Yet another feature of the invention is that the liftgate power operating system preferably has a moveable link attached to the liftgate that is preferably shaped and guided to move concentrically with respect to the hinge axis of the liftgate so that the moveable link can be sealed easily and/or located exit outside the liftgate perimeter seal.

Still yet another feature of the invention is that the liftgate power operating system has a segmented drive linkage consisting of three links (a linear rack link, a link that is pivotally attached to the liftgate and an intermediate link.) to reduce the number of parts required for the power operating system.

Still yet another feature of the invention is that the power operating system can be used in conjunction with a counterbalance system.

These and other objects, features and advantages of the invention will become more apparent from the following description of a preferred embodiment taken in conjunction with the accompanying drawing.

BRIEF DESCRIPTION OF THE DRAWINGS

The presently preferred embodiment of the invention is disclosed in the following description and in the accompanying drawings, wherein.

DETAILED DESCRIPTION OF THE PREFERRED EMBODIMENT

Figure 2:
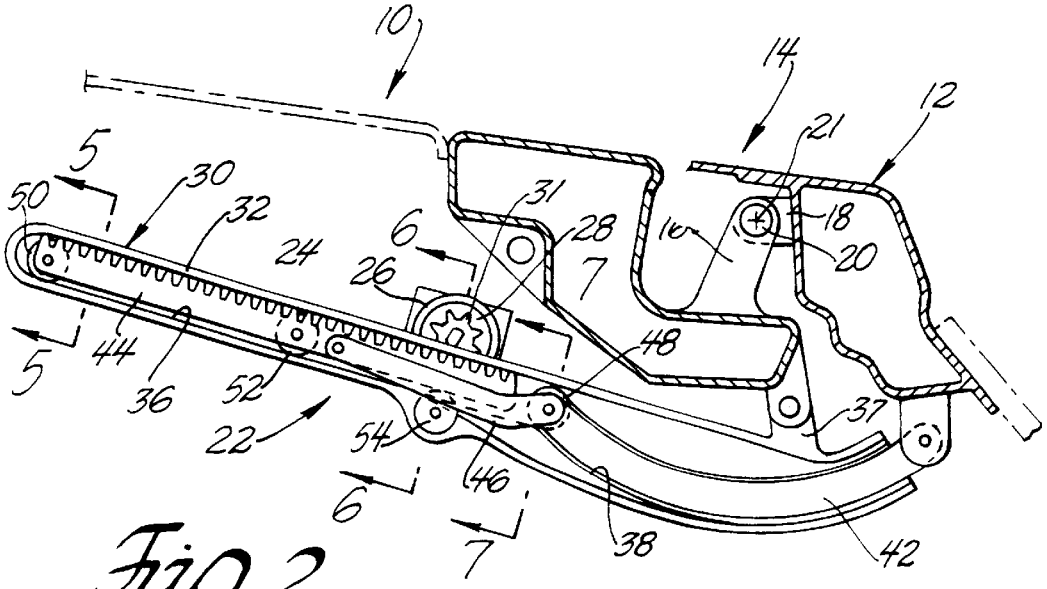
FIG. 2 is an enlarged side view of the right hand drive unit of the power operating system of FIG. 1 showing the drive unit with parts removed to show internal detail when the liftgate is closed.
Figure 3:
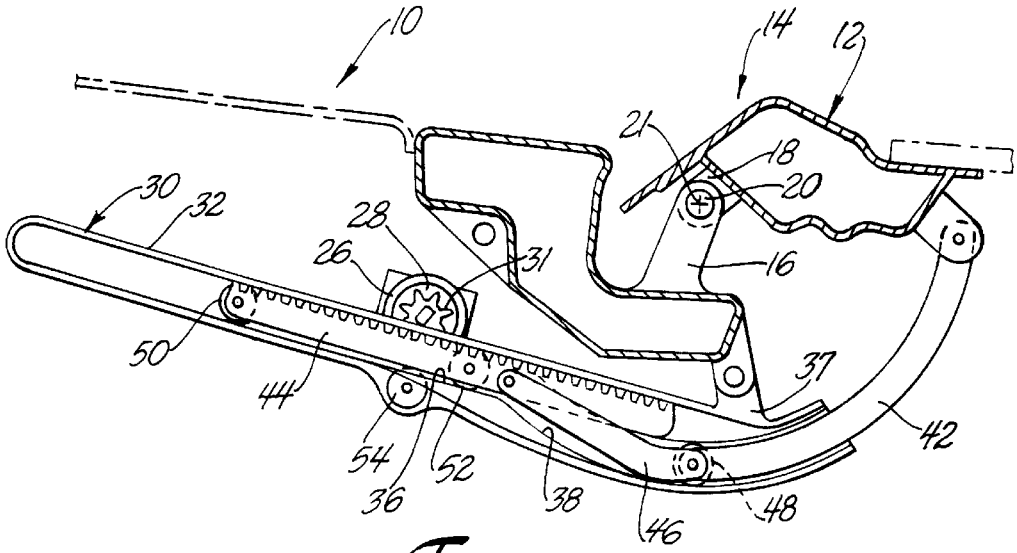
FIG. 3 is an enlarged side view of the right hand drive unit shown in FIG. 2 with parts removed to show internal detail when the lift gate is partially open.
Figure 4:
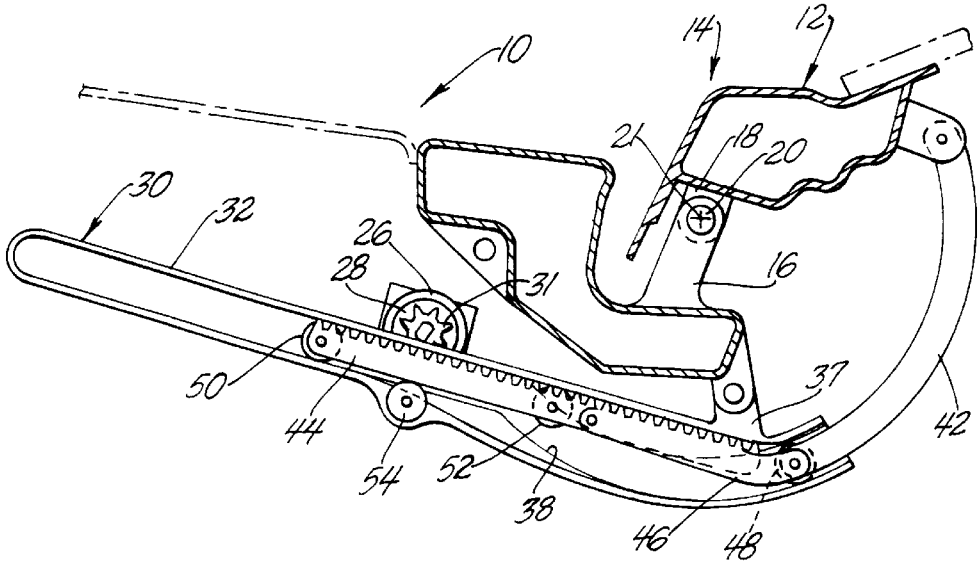
FIG. 4 is an enlarged side view of the right hand drive unit shown in FIG. 2 with parts removed to show internal detail when the liftgate is in the fully open position.
Figure 5:
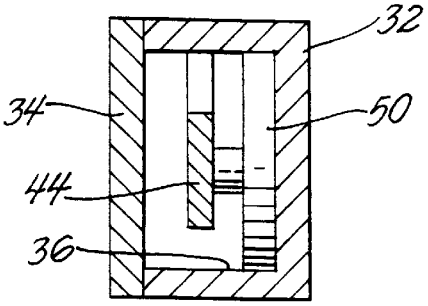
FIG. 5 is a section taken substantially along the lines 5—5 of FIG. 2 looking in the direction of the arrows.
Figure 6:
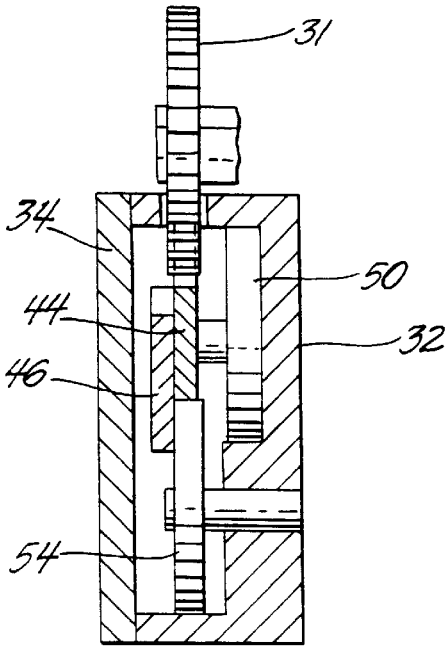
FIG. 6 is a section taken substantially along the lines 6—6 of FIG. 2 looking in the direction of the arrows.
Figure 7:
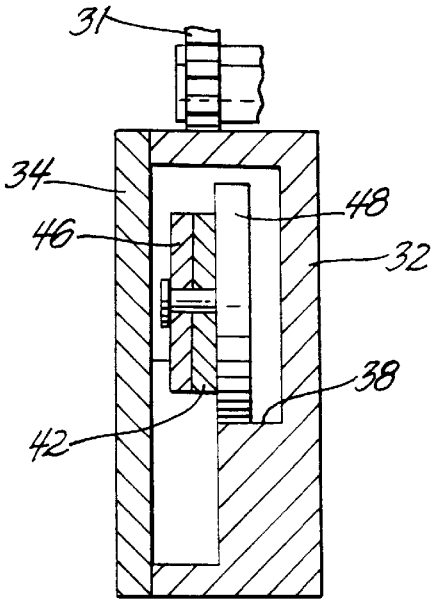
FIG. 7 is a section taken substantially along the lines 7—7 of FIG. 2 looking in the direction of the arrows.

Referring now to the drawings, vehicle 10 has a liftgate 12 that is attached to the aft end of the vehicle roof by two hinge assemblies. The typical right hand hinge assembly 14 is shown in FIGS. 2, 3 and 4.

Figure 1:
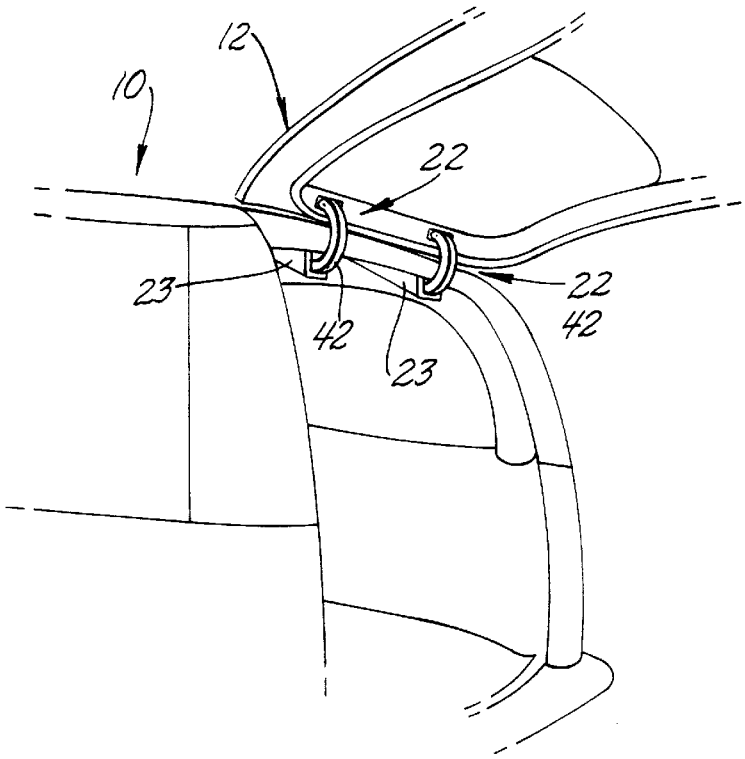
FIG. 1 is a perspective view of the rear portion of a vehicle equipped with a liftgate power operating system of the invention showing the liftgate in an open position.

Hinge assemblies 14 have hinge portions 16 that are secured to a roof channel of the vehicle 10 and hinge portions 18 that are secured to a top channel of liftgate 12. Hinge portions 18 are attached to hinge portions 16 by pivot pins 20 so that liftgate 12 pivots about a hinge axis indicated at 21 in FIGS. 2, 3 and 4 from a closed position shown in FIG. 2 through a partially open position shown in FIG. 3 to a fully open position shown in FIGS. 1 and 4. Hinge axis 21 is generally substantially horizontal and liftgate 12 is generally permitted to pivot about 90° about hinge axis 21. However, the range of movement can be varied substantially from one vehicle 10 to another.

Liftgate 12 is opened and closed by a power operating system that includes two identical drive units 22 that are installed in the aft end of the vehicle roof. Drive units 22 are laterally spaced from each other and near the respective vertical body pillars at the aft end of vehicle 10 that define the rear opening that is closed by liftgate 12. The typical drive unit 22 is shown in FIGS. 2, 3 and 4 with the interior trim cover 23 removed to show detail of drive unit 22.

Each drive unit 22 comprises a bracket 24 that is secured to the vehicle body in a fixed position for supporting several parts including a reversible electric motor 26, a gear reduction unit 28, and a two piece housing 30 comprising a track base 32 and a track cover 34. Track cover 34 is removed in FIGS. 2, 3 and 4 to show internal detail and drive unit parts that are disposed in housing 30. Electric motor 26 has an output that drives a pinion gear of the gear reduction unit 28. Pinion gear drives output gear 31 via internal gears to provide speed reduction and torque multiplication.

Track base 32 includes a forward linear track 36 and a contiguous rearward curved track 38. Bracket 24 attaches the middle of track base 32 to the vehicle body via the housing for electric motor 26 and gear unit 28 while hanger 37 attaches the aft end of track base 32.

Track housing 30 is generally linear and slanted to hug the aft end of the vehicle roof, particularly the box beam that carries the hinge portions 16 as best shown in FIGS. 2, 3 and 4, in order to maximize unobstructed load height at the liftgate opening. Rearward curved track preferably has a radius of curvature that is centered on the hinge axis 21 of lift gate 12 as explained below. The rearward portion of housing 30 bulges slightly to accommodate the curved track 38.

A segmented drive linkage 40 is disposed in housing 30 and moves with respect to housing 30. Segmented drive linkage 40 comprises an elongated arcuate link 42, a rack link 44 that is preferably linear, and an intermediate link 46. Arcuate link 42 preferably has a radius of curvature that is centered on hinge axis 21 and matches that of rearward curved track 38 so that arcuate link 42 swings about hinge axis 21 between the retracted position shown in FIG. 2 and the extended position shown in FIGS. 1 and 4 via the intermediate position shown in FIG. 3. The outboard end of link 42 is pivotally attached to liftgate 12 while the einboard end supports a roller 48 that runs in the curved track 38. Roller 48 remains in track 38 when lift gate 12 is fully open as shown in FIG. 4. The pivotal or swinging movement of link 42 about hinge axis 21 eliminates pivotal movement of link 42 with respect to liftgate 12 and consequently link 42 can be sealed at the vehicle body exit easily. The body exit for link 42 can even be placed in the vertical body pillar outside the liftgate perimeter seal (not shown).

Linear rack link 44 is stored in the narrow forward portion of housing 30 when liftgate 12 is closed as shown in FIG. 2 and then travels into the bulged rearward portion when liftgate 12 is opened as shown in FIG. 4. The linear travel or translation of the linear rack link 44 is guided by three rollers 50, 52 and 54. Rollers 50 and 52 are rotably attached to the inner end and middle of the rack link 44 respectively. Rollers 50 and 52 run in forward linear track 36. Roller 54 is rotably attached to housing 30 with its axis parallel to and radially spaced from the axis of output gear 31. Roller 54 supports rack link 44 at a location beneath output gear 31 to provide efficient engagement of the rack teeth with output gear 31 as well as guide linear translation of rack link 44, particularly in the extended position. Intermediate link 46 has an outer end pivotally attached to an inner end of arcuate link 42 at the axis of roller 48 and an inner end pivotally attached to a mid point of rack link 44.

The power operating system further includes a conventional power source such as the vehicle battery (not shown) and a suitable motor control for energizing and shutting off the reversible electric motor 26. Motor controls are well known to those skilled in the art and thus need not be described in detail.

The power operating system operates as follows. Assuming that the liftgate 12 is closed as shown in FIG. 2, electric motor 26 is energized to open liftgate 12. When energized, electric motor 26 rotates output 31 counterclockwise driving rack link 44 and the inner end of intermediate link 46 toward the aft end of vehicle 10 (toward the right as viewed in FIG. 2). Intermediate link 46 moves rearward and simultaneously pivots clockwise guided by roller 48 attached to arcuate link 42 which rotates counterclockwise about hinge axis 21 to the intermediate position shown in FIG. 3. Electric motor 26 continues to drive rack link 44 until arcuate link 38 is driven to the fully extended position shown in FIGS. 1 and 4. This raises liftgate 12 from the closed position shown in FIG. 2 to the fully open position shown in FIGS. 1 and 4. When the liftgate 12 is fully opened, a limit switch or the like is actuated to shut off electric motor 26. Liftgate 12 is closed by reversing electric motor 26 so that output gear 31 drives segmented drive linkage 40 back to the retracted position shown in FIG. 2.

It should be noted that the intermediate link 46 is shaped and interconnected with arcuate link 42 and rack link 44 so that the outer end of intermediate link 46 does not travel overcenter when the tail gate 12 is fully open as shown in FIG. 4.

With a proper motor control circuit, electric motor 26 can be de-energized at any time in which case liftgate 12 can be stopped at any intermediate position and held in the intermediate position by the friction in gear train 28 without any need for a brake, detent or the like. The liftgate 12 can then be moved by energizing electric motor 26 or the liftgate 12 can then be moved manually because gear train 28 can be designed with sufficient efficiency to permit back drive to electric motor 26.

The power operating system can be designed to work alone or in conjunction with gas springs (not shown) which are well known in the art with the primary adjustment being the size of the electric motor 26.

The power operating system described above preferably includes two identical drive units 22 for balanced operation and reduced manufacturing costs. However, the drive units need not be identical and in some instances, a single drive unit may be sufficient.

It is also possible to use two drive units with a single reversible electric motor driving both gear trains 28. In such an arrangement the axis of the electric motor is parallel to the axis of the several gears of gear train 28 thereby eliminating the need for a cross axis gear arrangement and possible need for a clutch in order to back drive the electric motor and thus operate the liftgate manually. The same is true with a power operating system having two identical drive units where the axes of the individual electric motors 26 are parallel to the axes of the respective drive trains.

Figure 8:
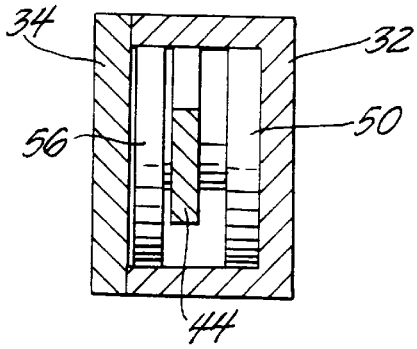
FIG. 8 is a section similar to FIG. 5 showing a modification.

It is also possible to duplicate tracks 36 and 38 in cover 34 and provide a second set of rollers teamed with rollers 48, 50 and 52. A typical set comprising rollers 50 and 56 is shown in FIG. 8. In other words, many modifications and variations of the present invention in light of the above teachings may be made. It is, therefore, to be understood that, within the scope of the appended claims, the invention may be practiced otherwise than as specifically described.

We claim:

1. A power operating system for opening and closing a vehicle liftgate that is pivotally attached to an aft end of a vehicle roof for pivotal movement between an open position and a closed position about a hinge axis comprising:

at least one drive unit that includes a reversible electric motor, a housing having a forward linear track and a contiguous rearward curved track, a segmented drive linkage that is disposed in the housing, the segmented drive linkage having an elongated arcuate link that is adapted for pivotal attachment to the vehicle liftgate at one end and that is guided by the rearward curved track, a linear rack link that is guided by the forward linear track, and an intermediate elongated link that has an inner end that is pivotally attached to a mid point of the linear rack link and an outer end that is pivotally attached to an inner end of the elongated arcuate link, the linear rack link being driven by the reversible electric motor via an output gear.

2. The power operating system as defined in claim 1 further including a plurality of rollers for guiding linear translation of the linear rack link.

3. The power operating system as defined in claim 2 wherein the plurality of rollers includes two rollers that are rotatably mounted on the linear rack link and that run in the forward linear track.

4. The power operating system as defined in claim 2 wherein the plurality of rollers includes one roller that is rotatably mounted on the linear rack link and that runs in the forward linear track and a roller that is rotatably attached to the housing and that supports the rack link in the vicinity of the output gear.

5. The power operating system as defined in claim 2 further including a roller that is rotably mounted on the arcuate link and that runs in the rearward curved track, and wherein the arcuate link and the rearward curved track have a radius of curvature that is centered on the hinge axis.

6. A power operating system for opening and closing a vehicle liftgate that is pivotally attached to an aft end of a vehicle roof for pivotal movement between an open position and a closed position about a hinge axis comprising:

at least one drive unit that includes a housing having a rearward curved track, a segmented drive linkage that is disposed in the housing, the segmented drive linkage having an elongated arcuate link that is adapted for pivotal attachment to the vehicle liftgate at one end and that is guided by the rearward curved track, an intermediate elongated link that has an outer end that is pivotally attached to an inner end of the elongated arcuate link, and a motor driven link that is attached to an inner end of the intermediate link and drives the inner end of the intermediate link in a linear direction.

7. The power operating system as defined in claim 6 further including a roller that is rotably mounted on the arcuate link or the intermediate link and that runs in the arcuate track.

8. The power operating system as defined in claim 6 further including a roller that is rotably mounted on the arcuate link and that runs in the arcuate track, and wherein the arcuate link and the rearward curved track have a radius of curvature that is centered on the hinge axis.

* * * * *